US006186836B1

(12) United States Patent
Ezawa et al.

(10) Patent No.: US 6,186,836 B1
(45) Date of Patent: Feb. 13, 2001

(54) MODULAR CONNECTOR HAVING MEANS FOR OPTIMIZING CROSSTALK CHARACTERISTICS

(75) Inventors: Katsuya Ezawa; Kenichi Hirokawa, both of Tokyo (JP)

(73) Assignee: Hirose Electric Co., Ltd., Tokyo (JP)

( * ) Notice: Under 35 U.S.C. 154(b), the term of this patent shall be extended for 0 days.

(21) Appl. No.: 09/410,065

(22) Filed: Oct. 1, 1999

(30) Foreign Application Priority Data

Oct. 16, 1998 (JP) ..... 10-295378

(51) Int. Cl.[7] ..... H01R 24/00
(52) U.S. Cl. ..... 439/676; 439/941
(58) Field of Search ..... 439/676, 941, 439/701, 541.5, 344, 722

(56) References Cited

U.S. PATENT DOCUMENTS 5,186,647 * 2/1993 Denkmann et al. ..... 439/676
5,362,257 * 11/1994 Neal et al. ..... 439/941
5,531,612 * 7/1996 Goodall et al. ..... 439/676
5,586,914 * 12/1996 Foster, Jr. ..... 439/676
5,885,111 * 3/1999 Yu ..... 439/941
5,911,602 * 6/1999 Vaden ..... 439/941
5,921,818 * 7/1999 Larsen et al. ..... 439/941
6,102,730 * 8/2000 Kjeldahl et al. ..... 439/676

* cited by examiner

*Primary Examiner*—Paula A. Bradley
*Assistant Examiner*—Tho D. Tu
(74) *Attorney, Agent, or Firm*—Kanesaka & Takeuchi

(57) ABSTRACT

A modular connector comprises an insulating housing (100) having a plugging portion for plugging with a mating connector, a plurality of contact elements (201–208) supported by the insulating housing, the contact elements each having a contact section (201*a*–208*a*) arranged in the plugging portion, an intermediate section (201B–208B) secured to the insulating housing, and a connection section (201C–208C) extending from the intermediate section, a pair of the contact elements (201, 208) on opposite ends being twisted to intersect each other in the intermediate sections, the other pairs of the contact elements (202–207) being arranged such that the distance between adjacent contact elements decreases in the intermediate sections and increases in the connection sections.

6 Claims, 18 Drawing Sheets

MODULAR CONNECTOR HAVING MEANS FOR OPTIMIZING CROSSTALK CHARACTERISTICS

BACKGROUND OF THE INVENTION

1. Field of the Invention

The present invention relates to modular connectors and, particularly, to a modular jack type connector.

2. Description of the Related Art

Modular connectors are widely used in communications equipment. A modular connector comprises an insulating housing having a plugging portion for plugging with a mating connector and a plurality of contact elements supported by the insulating housing and is so compact that the contact elements are arranged very closely. Consequently, crosstalk or noise is produced between adjacent contact elements especially between elongated straight portions of the contact elements.

Japanese patent application Kokai Nos. 7-106010 and 8-64288 have proposed improvements in reduction of the crosstalk.

The proposed improvements do not need any additional components such as a ground plate or capacitor for reducing the crosstalk and are relatively simple and inexpensive. However, they have the following disadvantages.

These conventional modular connectors optimize the crosstalk characteristics by adjusting the overlap of only the intermediate sections of the contact elements. The intermediate sections have a substantially constant dimension for all of the modular connector. When the dimensions of the modular connector are changed, it is impossible to adapt for the change by adjusting the overlap of only the intermediate sections. Thus, there is little freedom in design for optimizing the crosstalk characteristics.

SUMMARY OF THE INVENTION

Accordingly, it is an object of the invention to provide a modular connector having a high degree of freedom in design for optimizing the crosstalk characteristics.

According to the invention there is provided a modular connector which comprises an insulating housing having a plugging portion for plugging with a mating connector; a plurality of contact elements supported by the insulating housing; the contact elements each having a contact section arranged within the insulating housing, an intermediate section fixed in the insulating housing, and a connection section extending from the intermediate section; a pair of the contact elements on opposite ends intersecting each other in the intermediate sections; and other pairs of the contact elements arranged such that a distance between them is decreased in the intermediate sections and increased in the connection sections.

According to one embodiment of the invention, one of the pairs of the contact elements is made from a first reed frame, and the other from a second reed frame, with one of the first and second reed frames being substantially flat.

According to another embodiment of the invention, the intermediate sections are molded with the insulating housing, with the connection sections bent in an L-shape from the insulating housing.

According to still another embodiment of the invention, the connection sections of the other pairs of the contact elements spread behind the L-shaped bends.

According to yet another embodiment of the invention, the connection sections of the contact elements permit mounting up to the L-shape bends.

According to another embodiment of the invention, the insulating housing has the plugging portions at two tiers or more, the contact elements being provided in each of the tiers, and the connection sections of the other pairs of the contact elements are spaced in each of the tiers so as to optimize crosstalk characteristics.

DESCRIPTION OF THE PREFERRED EMBODIMENTS

Embodiments of the invention will now be described with reference to the accompanying drawings.

Figure 1:
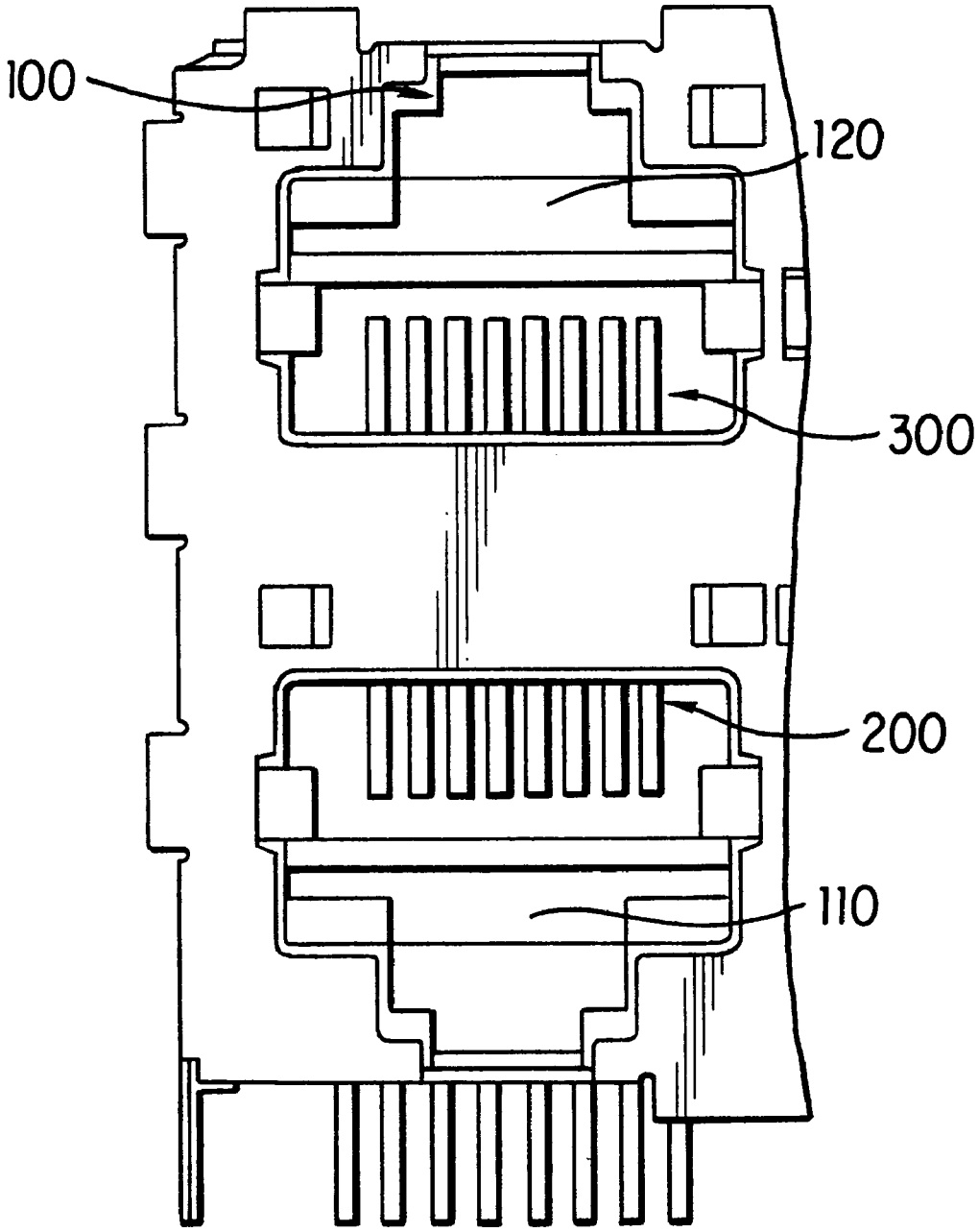
FIG. 1 is a front elevational view of part of a modular jack type connector according to an embodiment of the invention.
Figure 2:
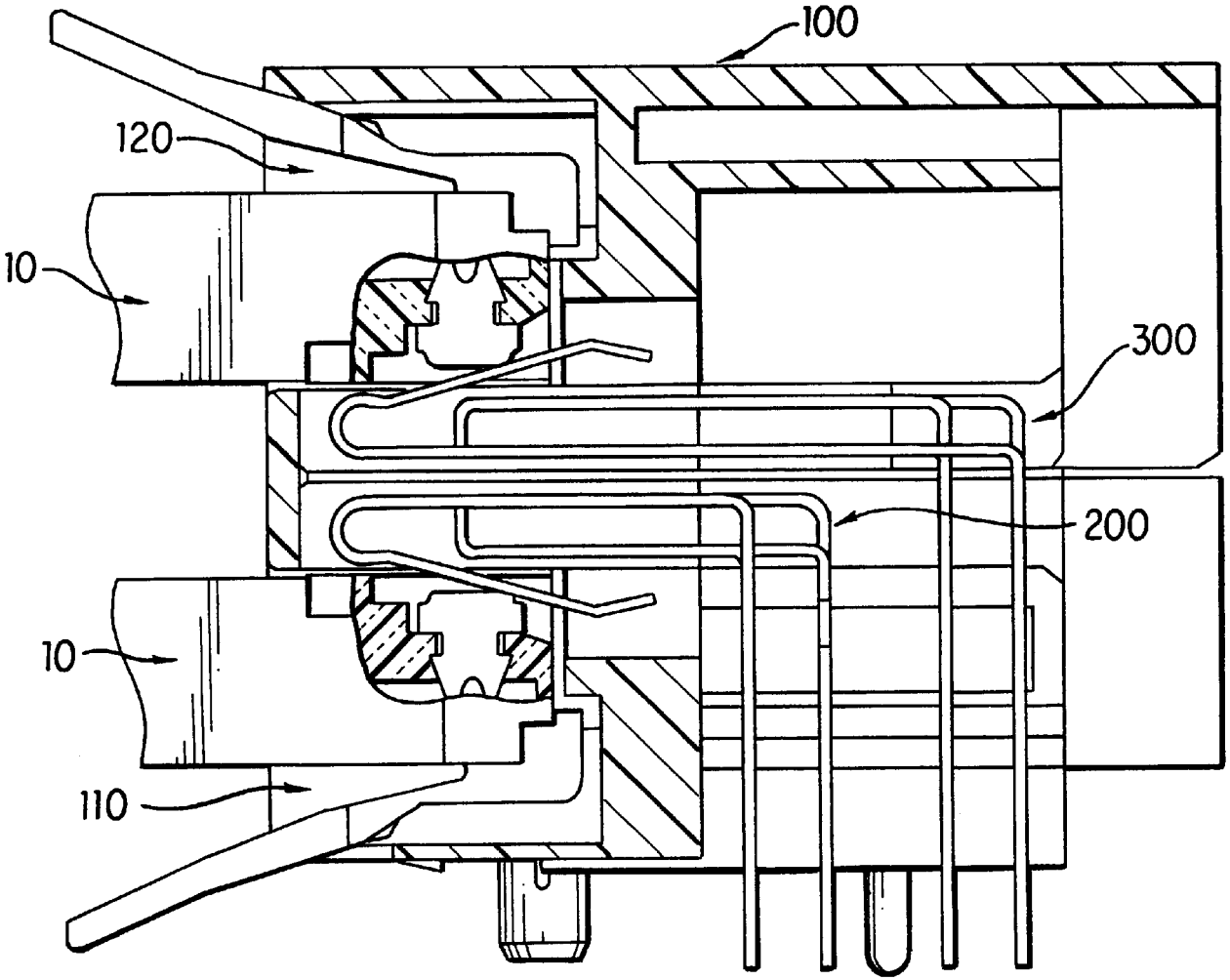
FIG. 2 is a sectional view of the modular jack type connector of FIG. 1.

FIG. 1 is a front elevational view of part of a modular jack type connector according to an embodiment of the invention, and FIG. 2 is a sectional view of the connector. An insulating housing 100 is covered by a shield plate and has upper and lower jack openings 120 and 110. Only one jack opening is shown for each of the upper and lower tiers. These jack openings 110 and 120 are constructed so as to receive modular plug type connectors 10 as shown in FIG. 2. The modular plug type connectors 10 are well known and will not be described in detail. A plurality of groups of contact elements 200 and 300 are provided in the jack openings 110 and 120, respectively. In order to provide high-speed transmission, there is provided a differential transmission system wherein a pair of data pulse signal and its inverted signal are transmitted simultaneously. Each of the contact groups 200 and 300 consists of eight contact elements in this embodiment.

The structure of the modular connector in each tier will be described in detail with respect to FIGS. 3–20.

Figure 3:
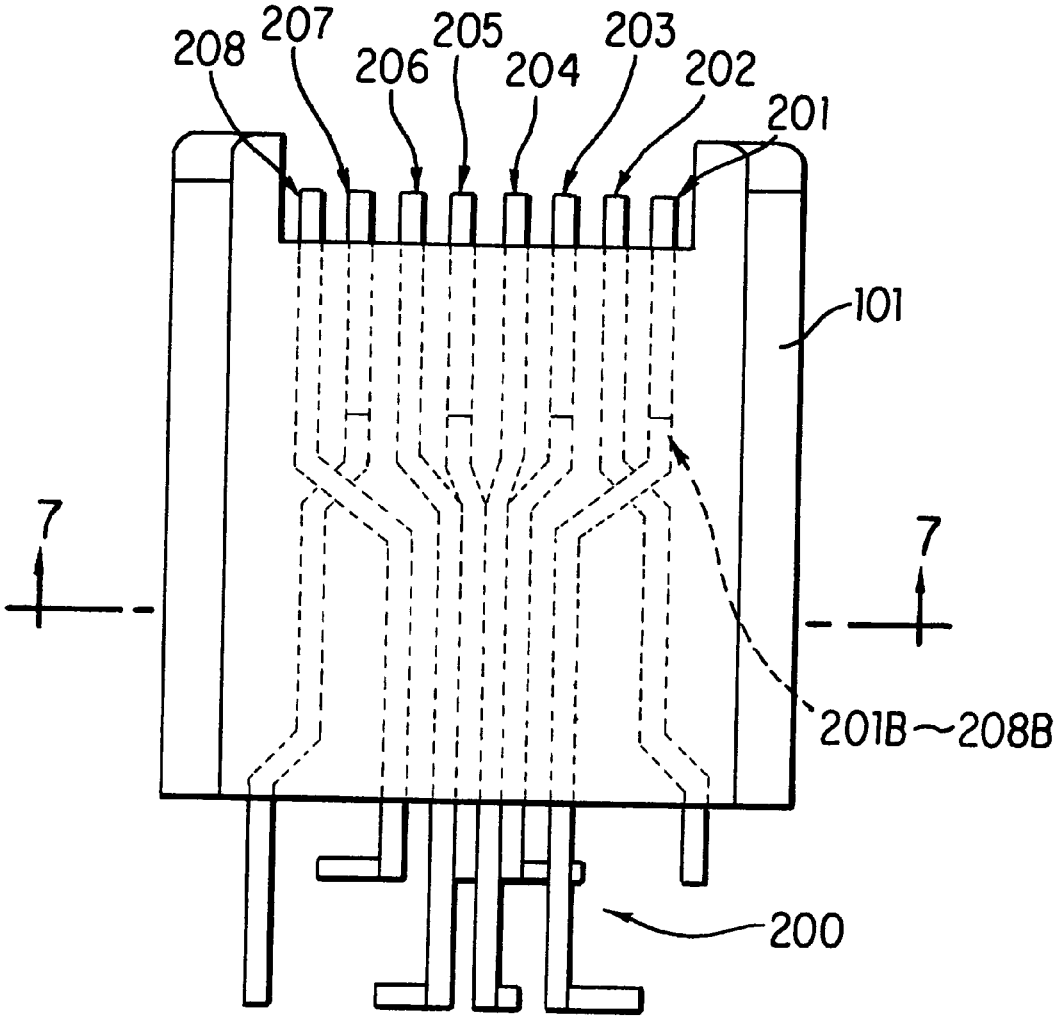
FIG. 3 is a top plan view of the lower modular jack type connector of the modular jack type connector of FIG. 1.
Figure 4:
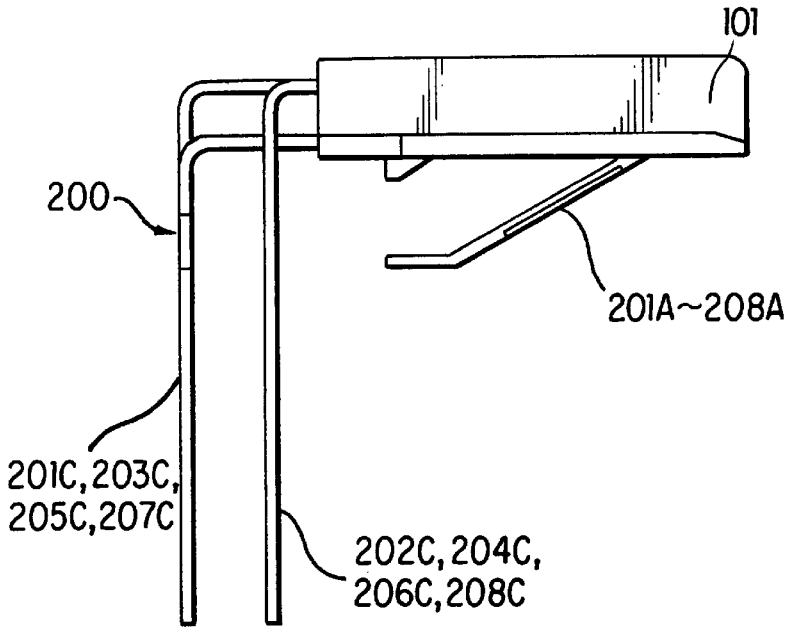
FIG. 4 is a side elevational view of the modular connector of FIG. 3.
Figure 5:
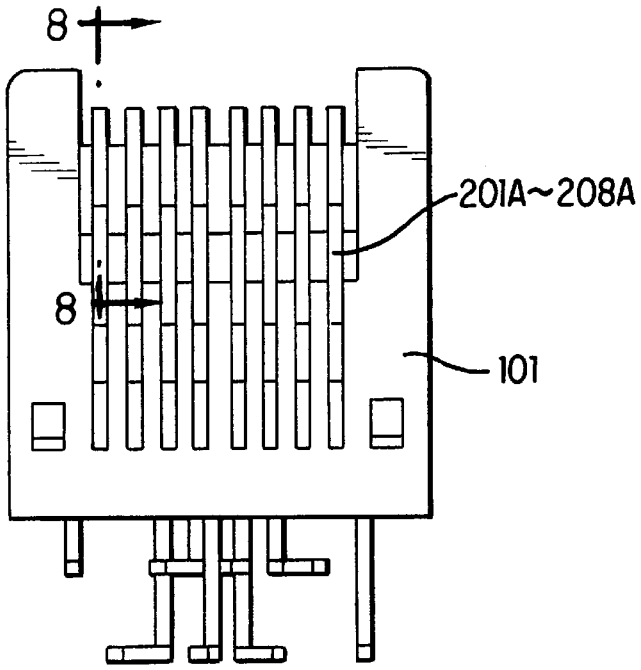
FIG. 5 is a bottom plan view of the modular connector of FIG. 3.
Figure 6:
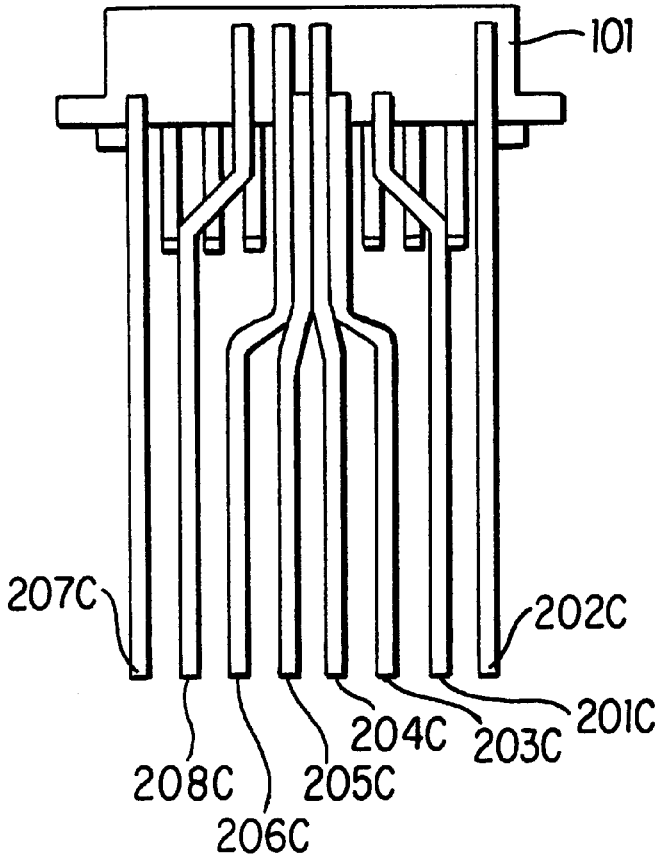
FIG. 6 is a rear elevational view of the modular connector of FIG. 4.
Figure 7:
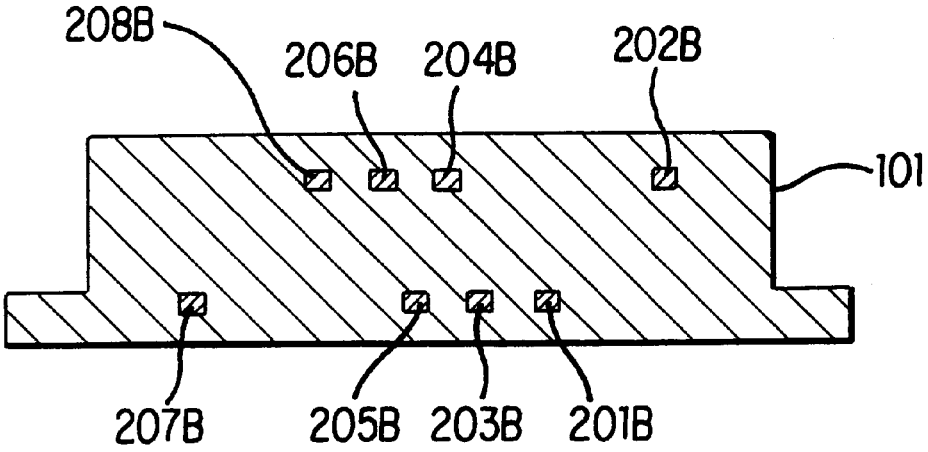
FIG. 7 is a sectional view taken along line 7—7 of FIG. 3.
Figure 8:
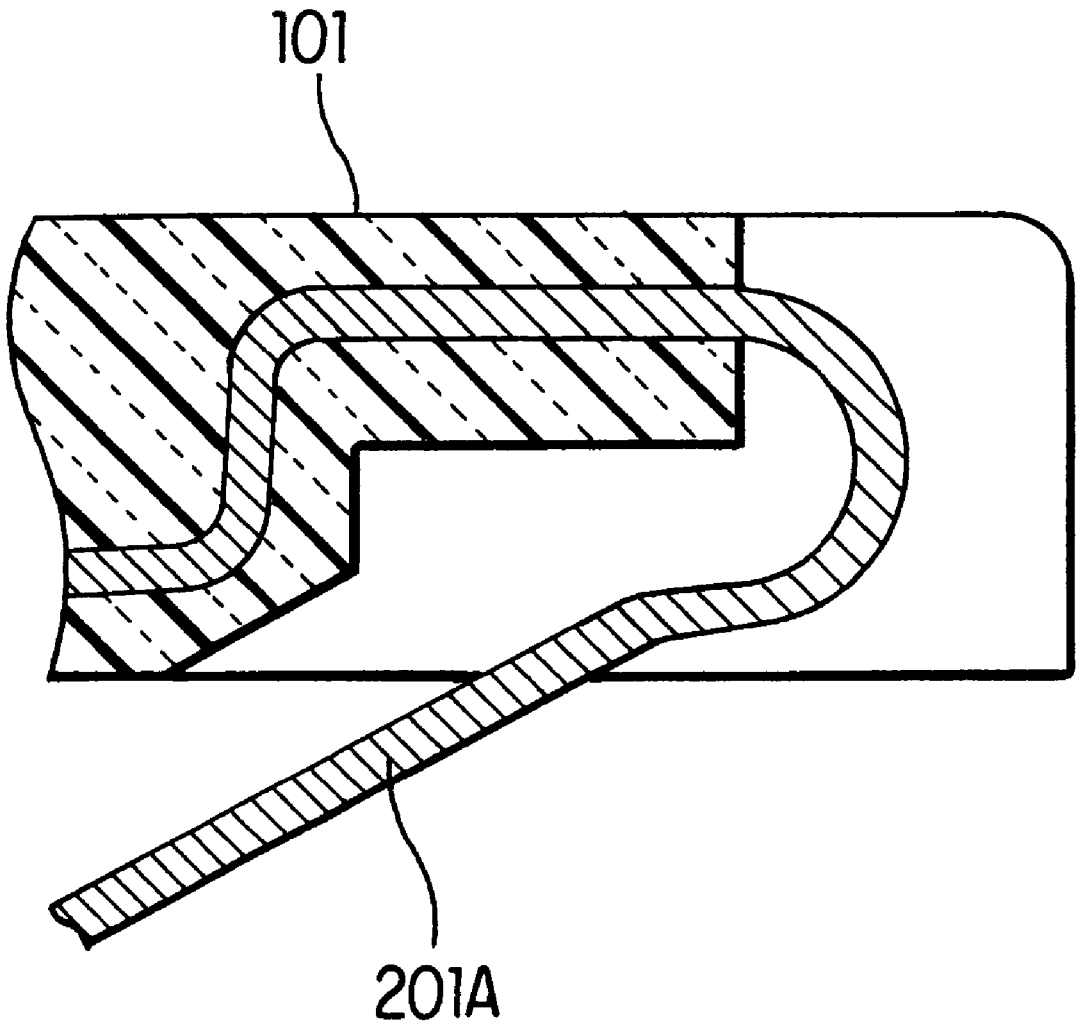
FIG. 8 is a sectional view taken along line 8—8 of FIG. 5.

The modular connector in the lower tier will be described with respect to FIGS. 3–13. FIG. 3 is a top plan view of the modular connector, FIG. 4 is a side elevational view thereof, FIG. 5 is a bottom plan view thereof, FIG. 6 is a rear elevational view thereof, FIG. 7 is a sectional view taken along line 7—7 of FIG. 3, and FIG. 8 is a sectional view taken along line 8—8 of FIG. 5. As shown in these figures, the lower modular connector comprises an insulating housing 101 and a group of contact elements 200 provided in the insulating housing 101. The contact element group 200 consists of eight contact elements 201–208 each having a contact section 201A–208A, an intermediate section 201B–208B, and a connection sections 201C–208C.

Figure 9:
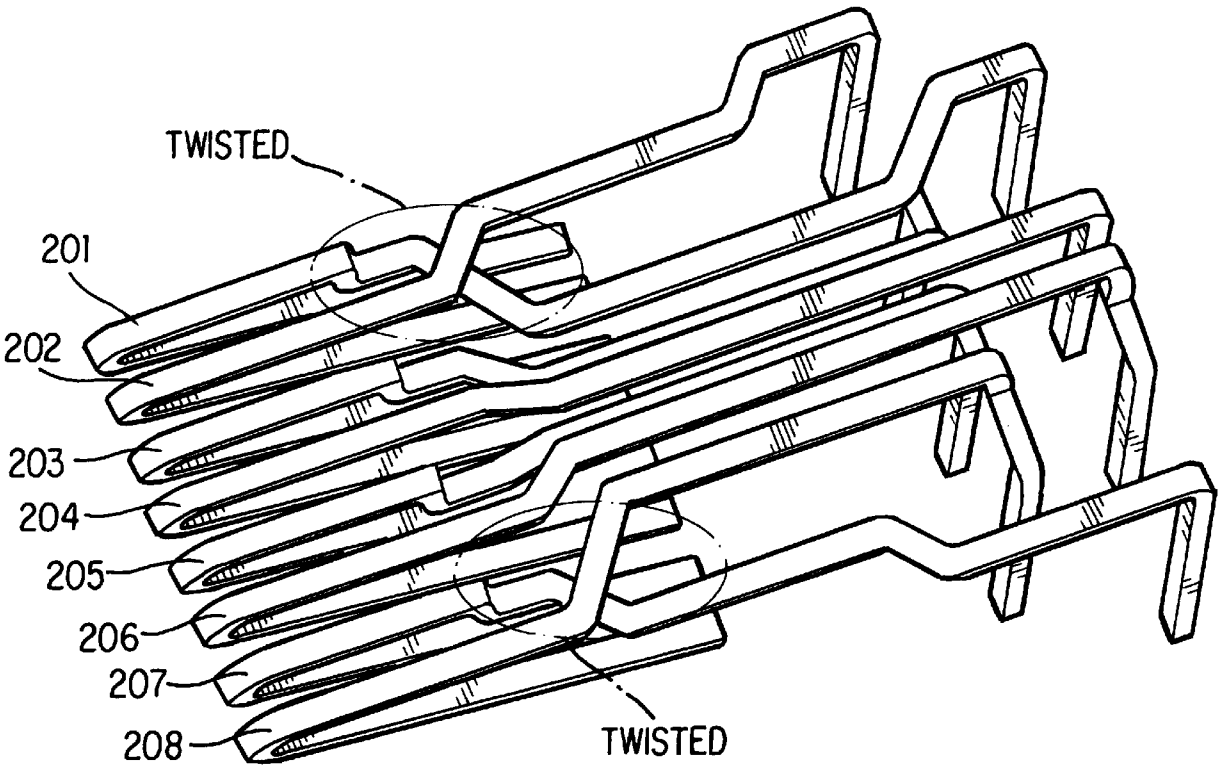
FIG. 9 is a perspective view of only the contact elements for the modular connector of FIG. 3.

FIG. 9 shows only the contact element group 200 arranged in the insulting housing 101 for easy understanding. The contact elements 201 and 202, and 207 and 208 make pairs 1 and 4, respectively, and are twisted to intersect each other in the intermediate section. The other contact elements 203 and 206, and 204 and 205 make pairs 2 and 3, respectively, and are bent such that the distance between them is reduced in the intermediate section and increased again at the connection section to minimize the crosstalk or noise.

Figure 10:
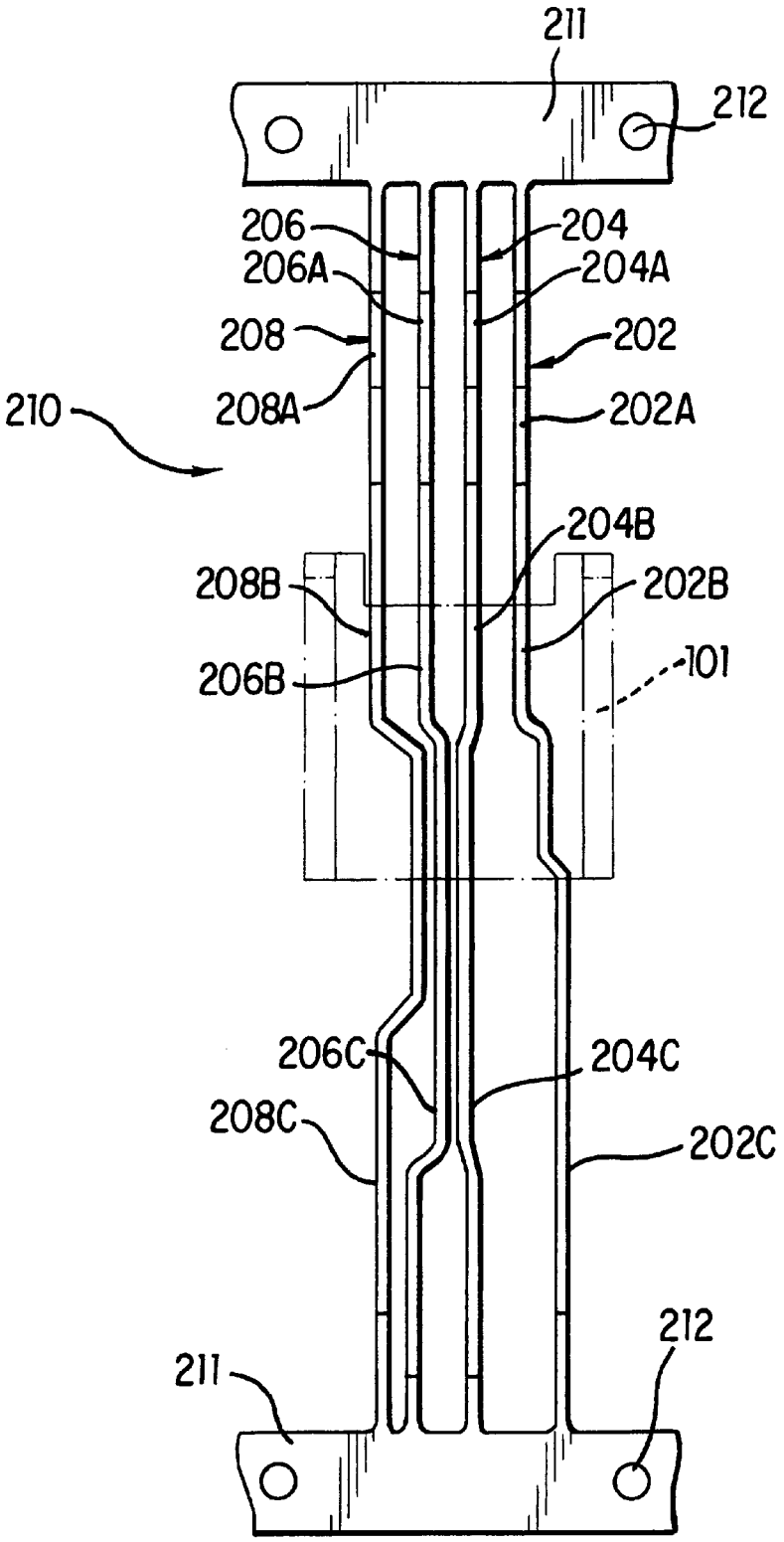
FIG. 10 is a top plan view of part of an upper reed frame to provide part of the contact elements for the modular connector of FIG. 3.
Figure 11:
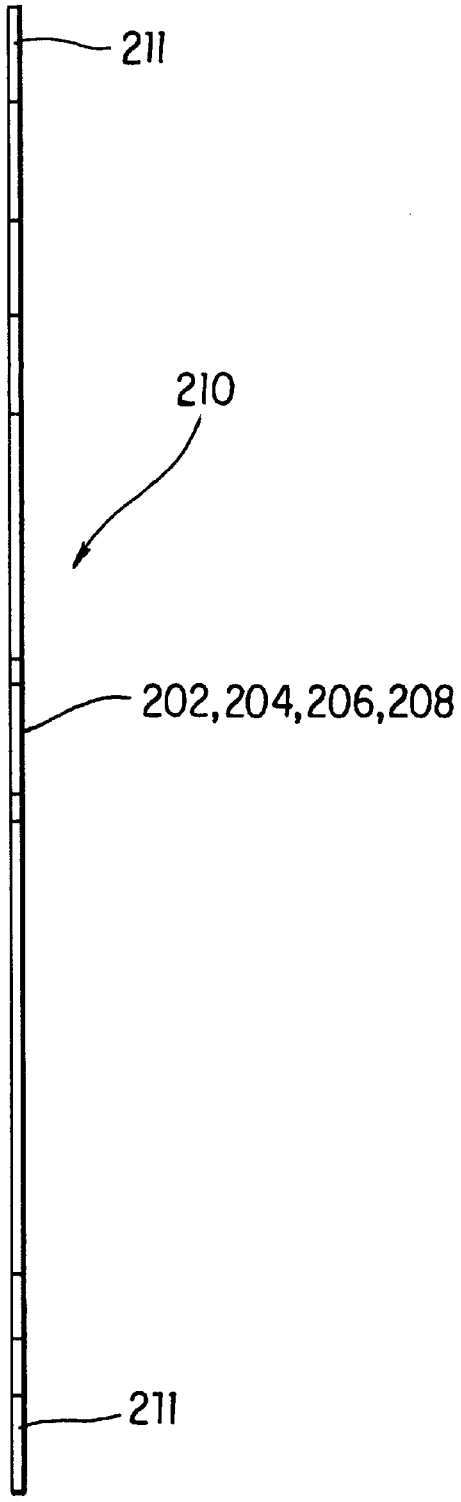
FIG. 11 is a side elevational view of the upper reed frame of FIG. 10.

The manufacture of the lower modular connector will be described with reference to FIGS. 10–13. FIG. 10 is a top plan view of an upper reed frame to provide the contact elements 202, 204, 206, and 208 and FIG. 11 is a side elevational view thereof. The upper reed frame 210 is made by stamping a resilient conductive metal sheet so as to provide elongated members for the contact elements 202, 204, 206, and 208 between the frame sections 211 having take-up holes 212. As best shown in FIG. 11, the upper reed frame 210 is substantially flat as a whole.

Figure 12:
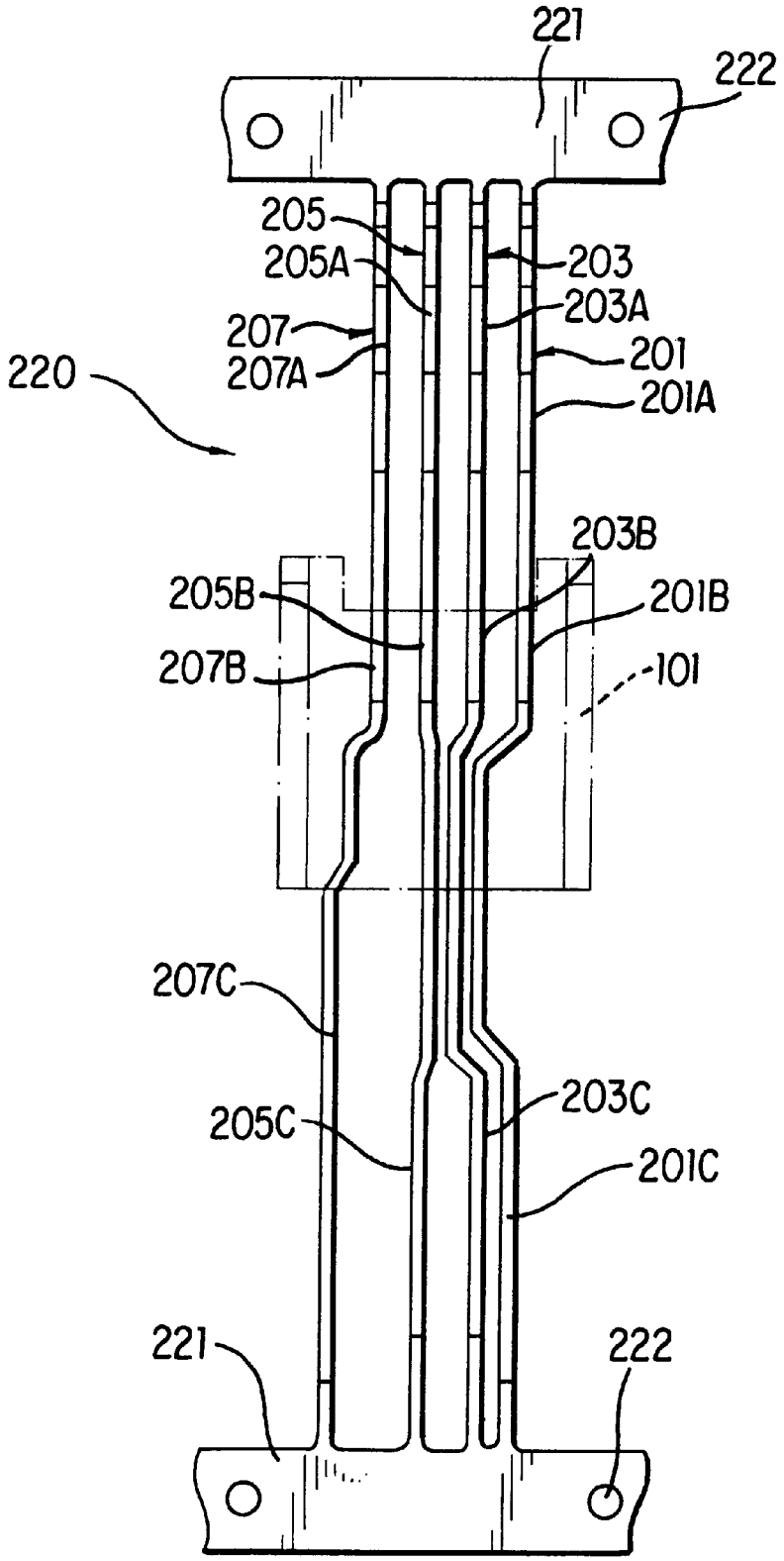
FIG. 12 is a top plan view of part of a lower reed frame to provide the rest of the contact elements for the modular connector of FIG. 3.
Figure 13:
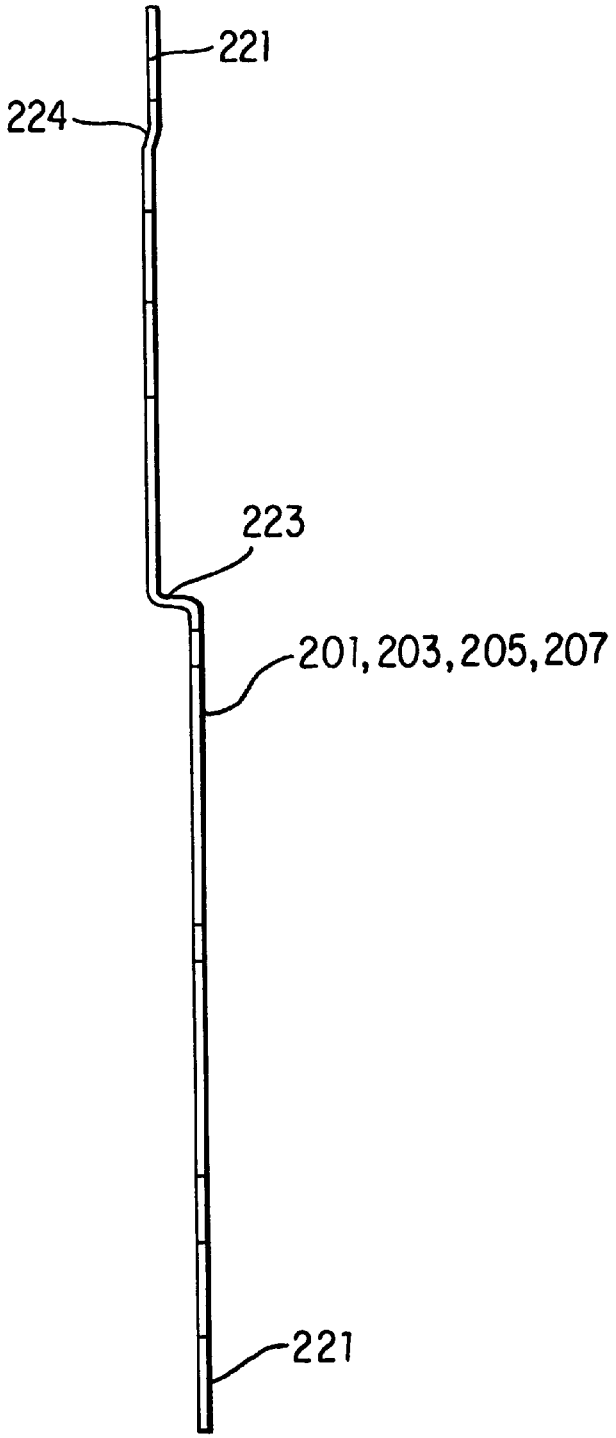
FIG. 13 is a side elevational view of the lower reed frame of FIG. 12.

Similarly, FIG. 12 is a top plan view of a lower reed frame to provide the contact elements 201, 203, 305, and 207 and FIG. 13 is a side elevational view thereof. The lower reed frame 220 is made by stamping and bending a resilient conductive metal sheet so as to provide the contact elements 201, 203, 205, and 207 between the frame sections 221 having take-up holes 222. As best shown in FIG. 13, the lower reed frame 220 is provided with bends 223 and 224 at a position corresponding to the intermediate section of the contact elements and at a position between the frame section 221 and the contact sections of the contact elements, respectively.

As shown by phantom line in FIGS. 10 and 12, the insulating housing 101 is molded with the intermediate sections of the contact elements after the upper and lower reed frames 210 and 220 are placed one upon another such that the contact sections of the contact elements are offset by a pitch. Then, the elongated portions corresponding to the contact elements are cut from the frame sections 211 and 221. Then, as best shown in FIGS. 4 and 9, the contact sections 201A–208A and the connection sections 201C–208C of the contact elements are bent downwardly from the insulating housing 101.

Figure 14:
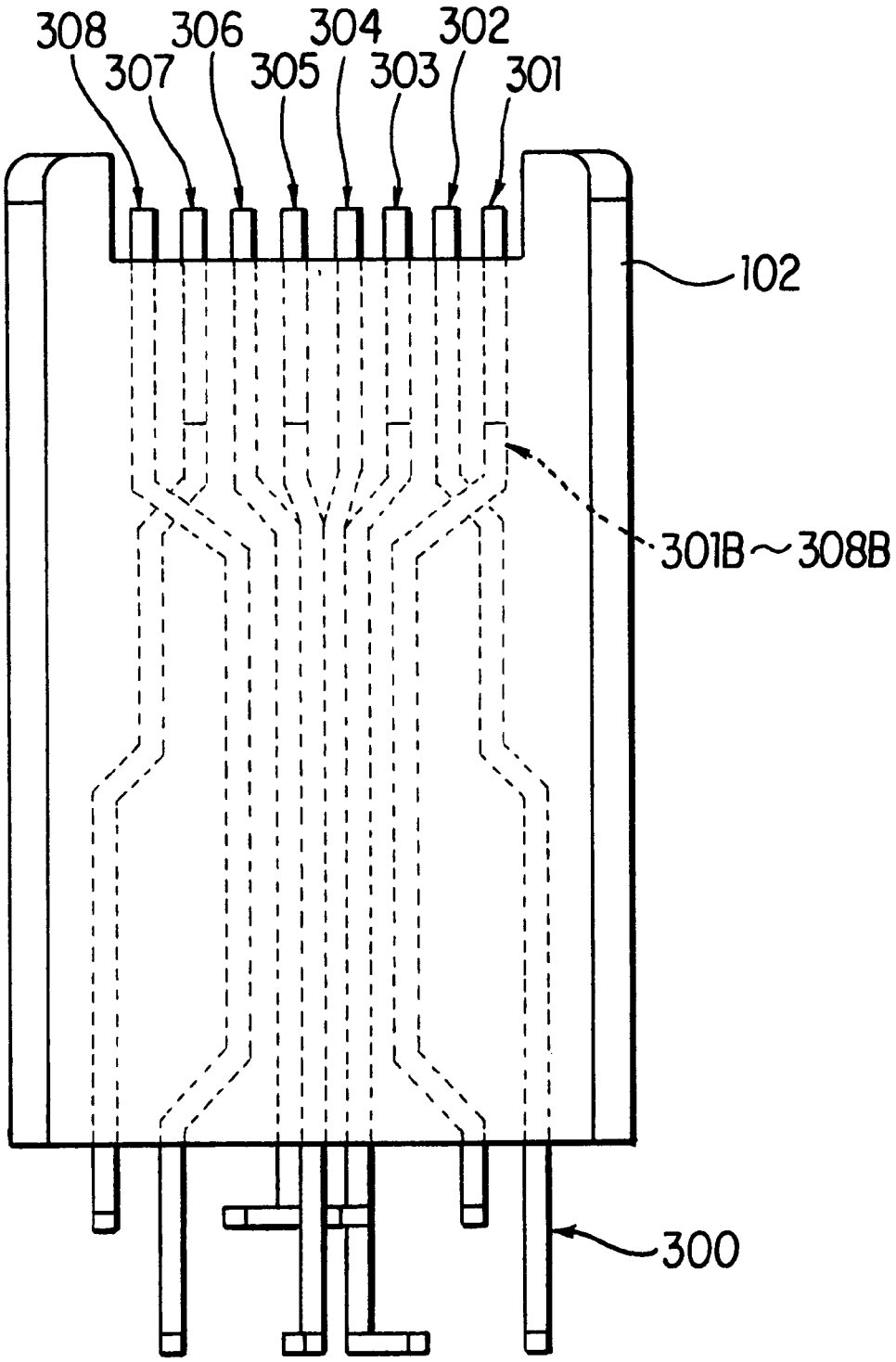
FIG. 14 is a bottom plan view of the upper modular connector for the modular jack connector of FIG. 1.
Figure 15:
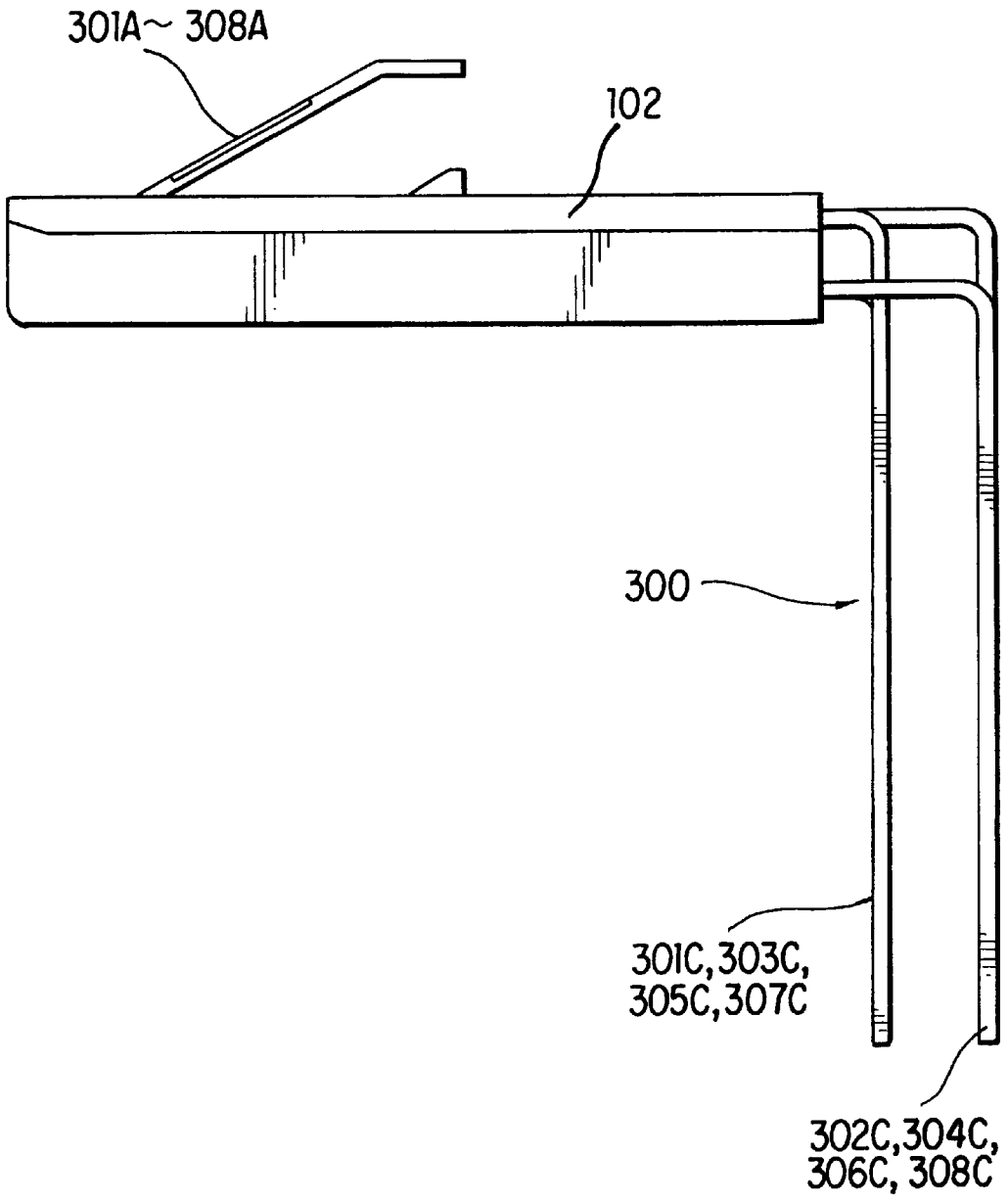
FIG. 15 is a side elevational view of the modular connector of FIG. 14.
Figure 16:
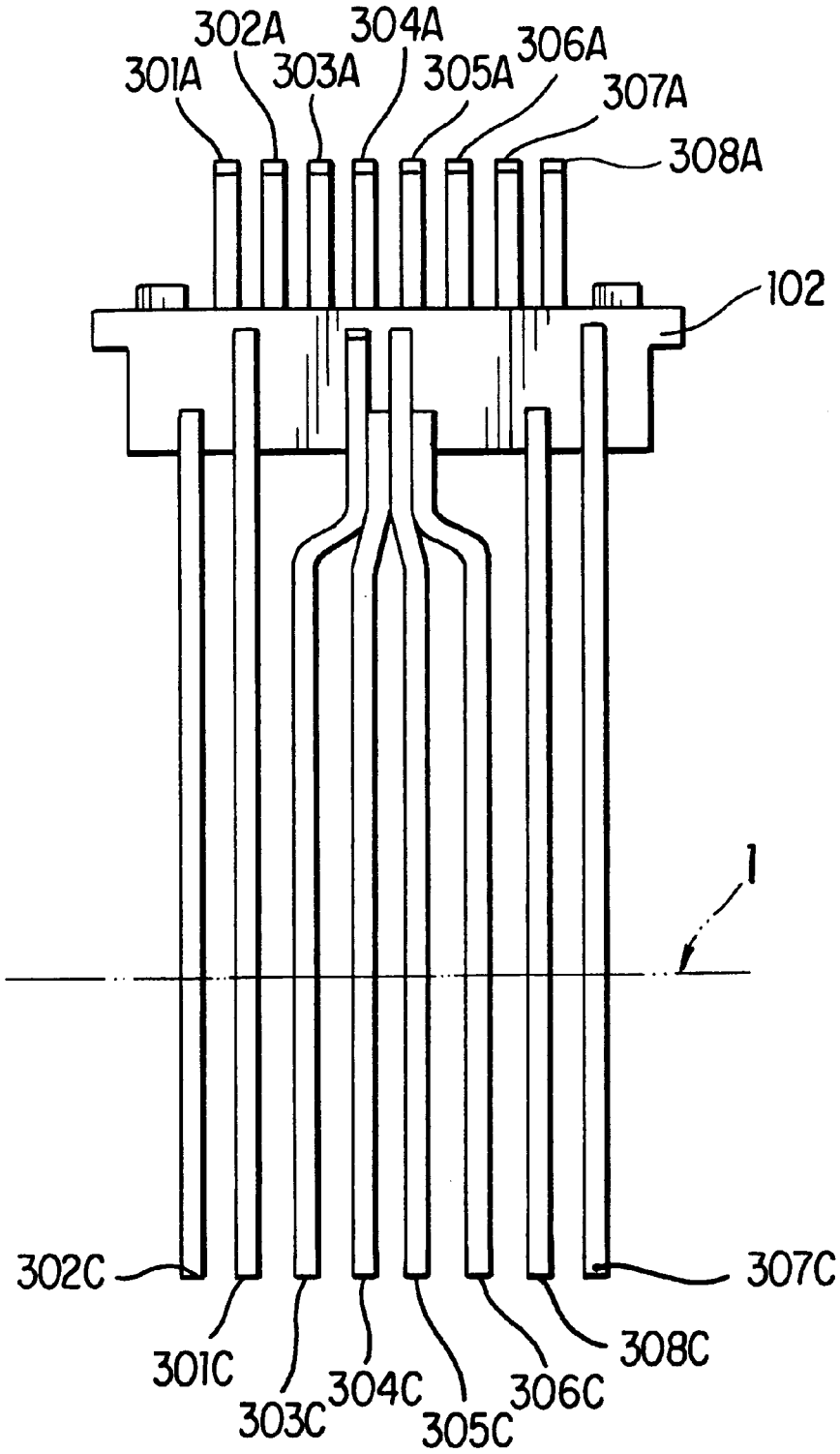
FIG. 16 is a rear elevational view of the modular connector of FIG. 14.

The structure of the upper modular connector will be described with reference to FIGS. 14–20. FIG. 14 is a bottom plan view of the modular connector, FIG. 15 a side elevational view thereof, and FIG. 16 is a rear elevational view thereof. As shown in these figures, the upper modular connector comprises an insulating housing 102 and a contact element group 300 supported by the housing 102. The contact element group 300 consists of eight contact elements 301–308. The contact elements 301–308 each have a contact section 301A–308A, an intermediate section 301B–308B, and a connection section 301C–308C.

The contact elements 301 and 302, and 307 and 308 make pairs 1 and 4, respectively, and are twisted to intersect each other in the intermediate section. The contact elements 303 and 306, and 304 and 305 make pairs 2 and 3 and are bent such that the distance between them is decreased in the middle portion and increased in the end portion. In this way, according to the invention, the distance between the contact elements is controlled not only in the intermediate section but also over the entire length, thus minimizing the crosstalk or noise.

Figure 17:
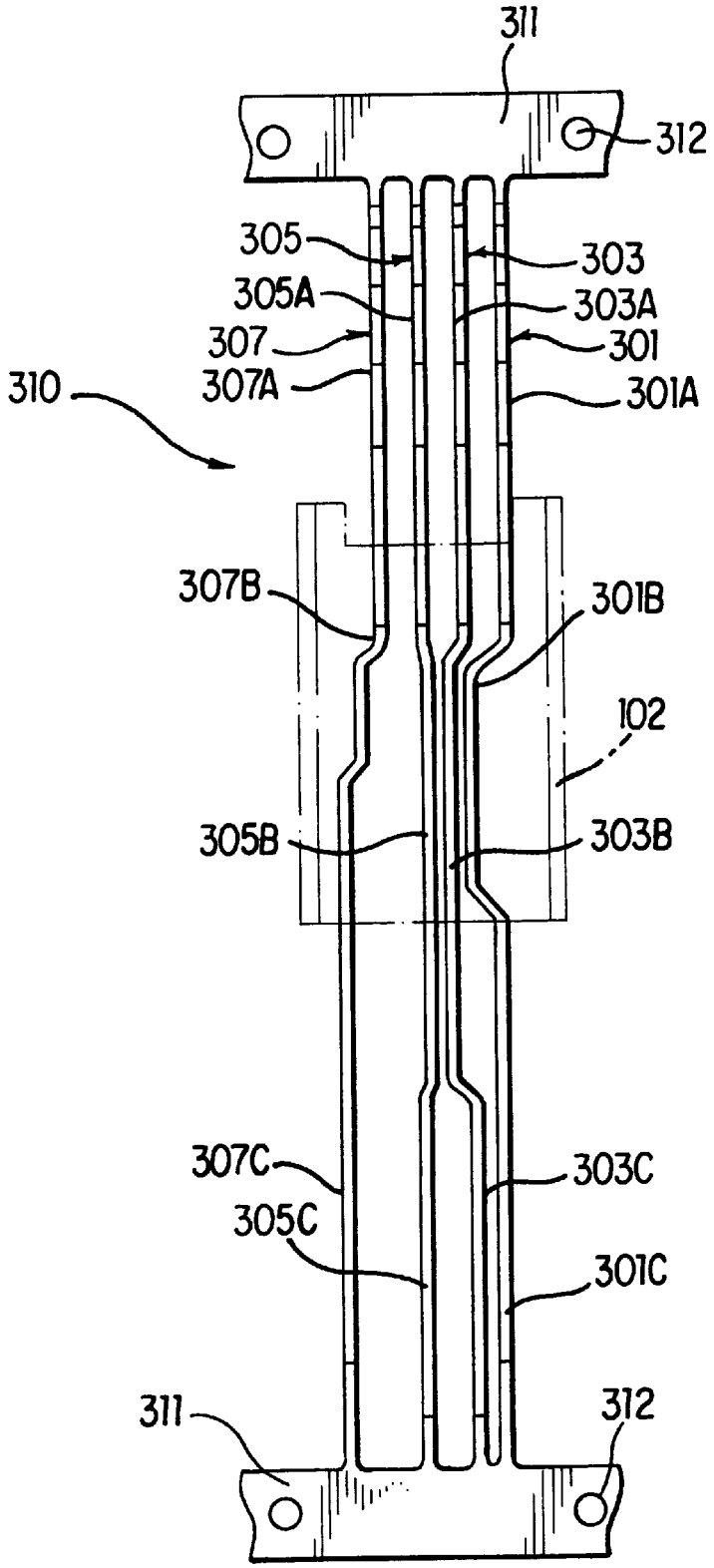
FIG. 17 is a bottom plan view of part of an upper reed frame to provide part of the contact elements for the modular connector of FIG. 14.
Figure 18:
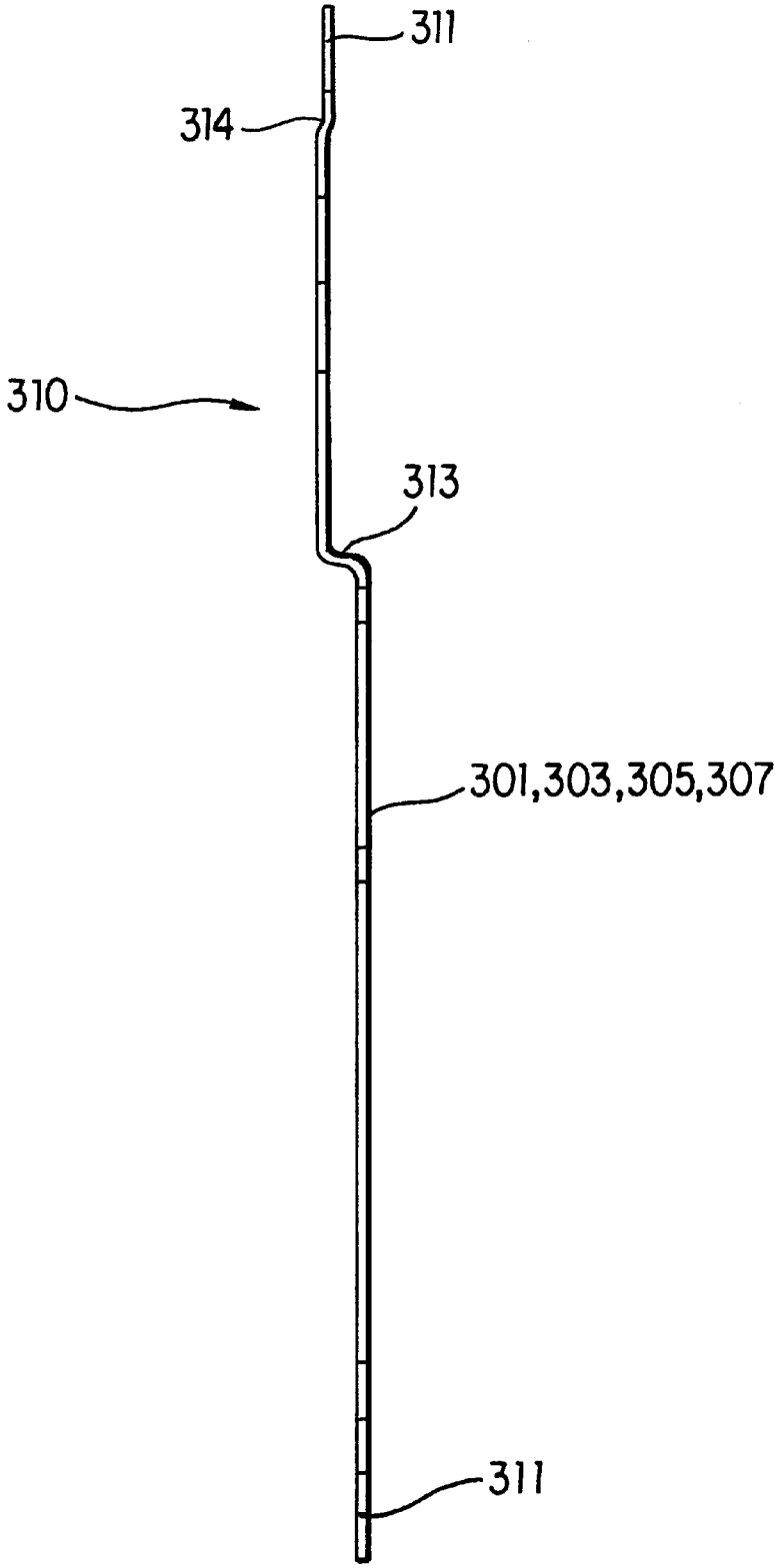
FIG. 18 is a side elevational view of the upper reed frame of FIG. 17.

A method of making the upper modular connector will be described with reference to FIGS. 17–20. FIG. 17 is a bottom plan view an upper reed frame 310 for providing the contact elements 301, 303, 305, and 307, and FIG. 18 is a side elevational view thereof. The upper reed frame 310 is made by stamping a resilient conductive metal sheet so as to provide elongated members for the contact elements 301, 303, 305, and 307 between the frame sections 311 having take-up holes 312. As best shown in FIG. 18, the upper reed frame 310 has bends 313 at a position corresponding to the intermediate sections of the contact elements and 314 at a position between the frame section 311 and the connection sections of the contact elements.

Figure 19:
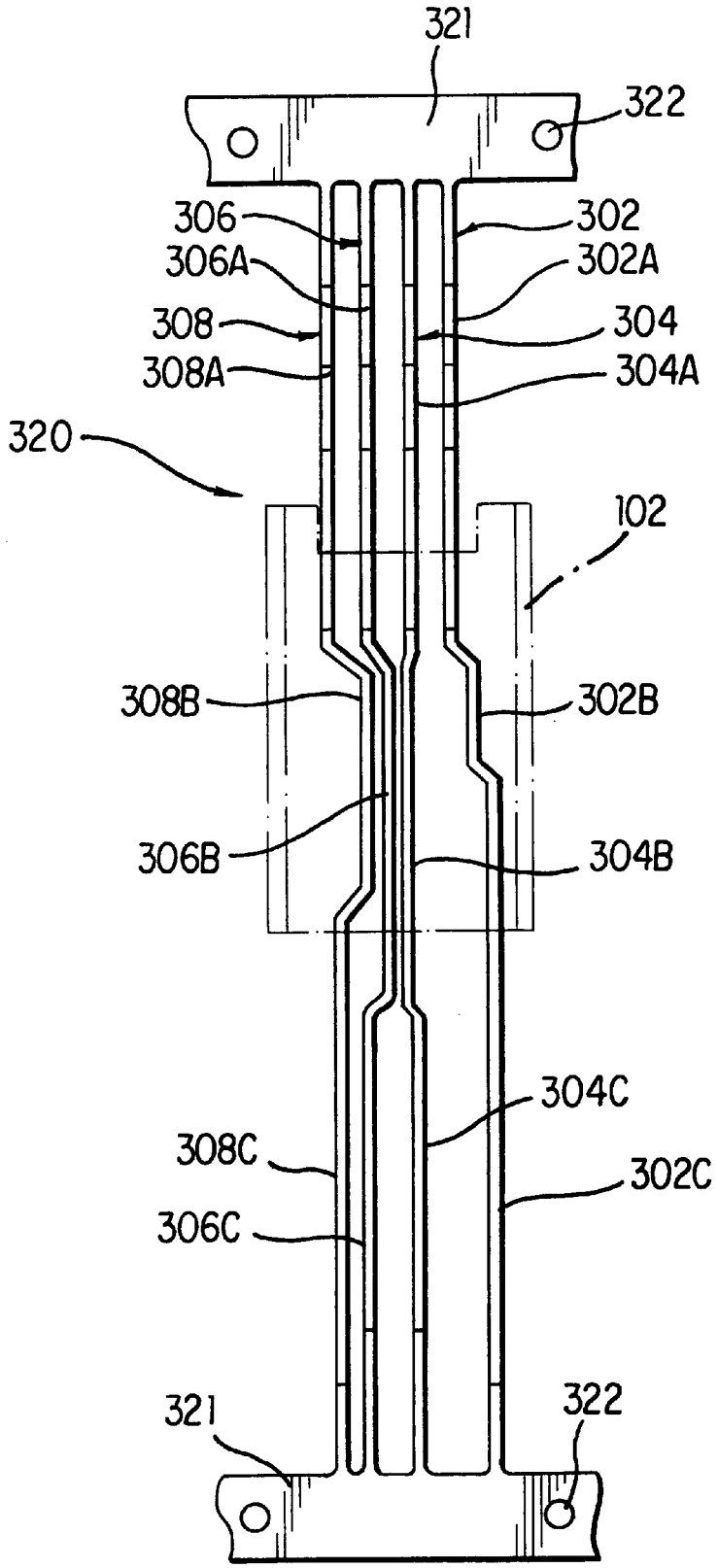
FIG. 19 is a bottom plan view of part of a lower reed frame to provide the rest of the contact elements for the modular connector of FIG. 14.
Figure 20:
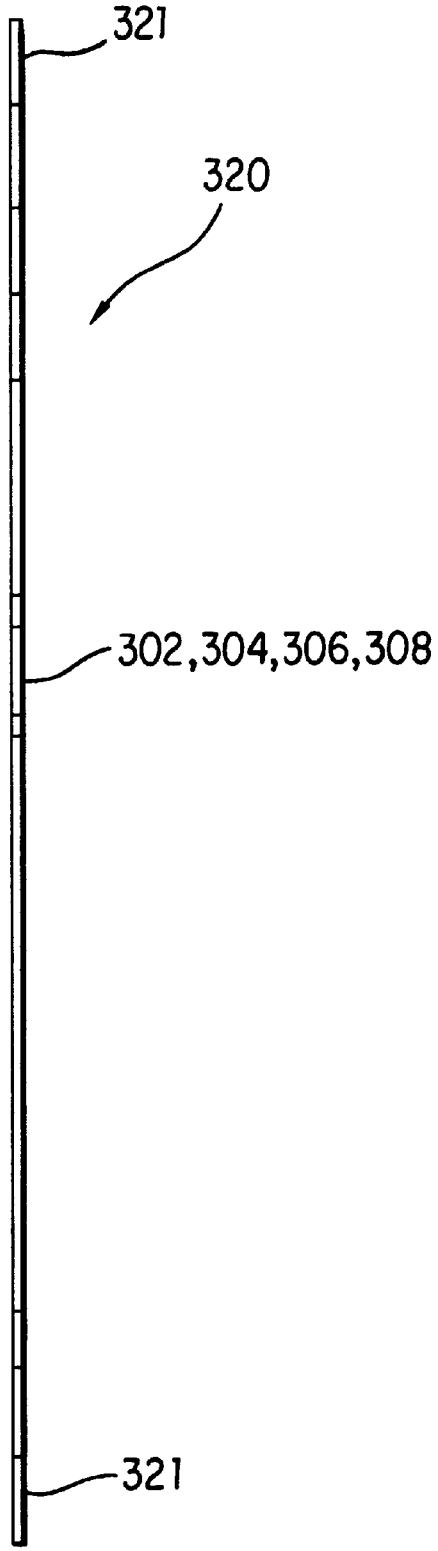
FIG. 20 is a side elevational view of the lower reed frame of FIG. 19.

Similarly, FIG. 19 is a bottom plan view of a lower reed frame 320 for providing the contact elements 302, 304, 306, and 308 and FIG. 20 is a side elevational view thereof. The lower reed frame 320 is made by stamping a resilient conductive metal sheet so as to provide elongated members for the contact elements 302, 304, 306, and 308 between supporting sections 321 having feeding holes 322. As best shown in FIG. 20, the lower reed frame 320 is flat as a whole.

The upper and lower reed frames 310 and 320 are placed one upon another such that the contact sections of the contact elements are offset by a pitch and then, as shown in FIGS. 17 and 19, the insulating housing 102 is molded in the intermediate sections of the contact elements. Then, the elongated members are cut off from the frame sections 311 and 321. AE best shown in FIG. 15, the contact sections 301A–308A are bent upwardly from the insulating housing 102 while the connection sections 301C–308C are bent downwardly from the insulating housing 102.

How the contact groups 200 and 300 arranged according to the invention work to reduce the crosstalk or noise will be described with respect to FIG. 3. Only the crosstalk between the pairs of the contact elements 201 and 202, and 203 and 206 will be described. For example, even if a negative crosstalk component is induced in the contact section 203A of the contact element 203 by the contact section 202A of the contact element 202 which is spaced by a pitch from the contact section 203A, a small positive crosstalk component is induced in the contact section 203A by the contact section 201A spaced two pitches from the contact section 203A. A negative and a small positive crosstalk components are induced in the front portion of the intermediate section 203B by the front portion of the intermediate section 202B spaced by a pitch and the front portion of the intermediate section 201B spaced by two pitches, respectively. A positive and a small negative crosstalk components are induced in the rear portion of the intermediate sections 203B by the intermediate sections 201B spaced by a pitch and by the intermediate sections 202B spaced by three pitches, respectively. In addition, a positive crosstalk component is induced in the L-shape of the contact sections 203C by the L-shaped connection sections 201C spaced by a pitch. The lengths of the respective sections and the distance between the contact elements are determined such that the sum of the crosstalk components is zero. The other contact elements are made in the same way.

The modular connector according to the invention not only improve the crosstalk but also reduces the height of the modular connector mounted on a board. As shown by phantom line in FIGS. 6 and 16, the mounting surface of the board 1 can be brought into the L-shaped sections.

Since the crosstalk is improved by not only the intermediate sections but also the connection sections, there is more freedom in design. It is easy to optimize the crosstalk characteristics of a connector of each tier by controlling the spread of the L-shaped connection sections of the respective contact elements. The contact elements are mounted on a board up to the L-shaped sections so that the height of the connector is minimized. Since the L-shaped sections are made outside the insulating housing, the upper and lower moldings are interchangeable for the two-tier receptacle. Since two kinds of reed frames are placed one upon another and the insulating housing is molded at the intermediate sections of the contact elements, it is easy to make the connector. One of the reed frames is made so flat that the integral molding is very easy.

What is claimed is:

1. A modular connector comprising:

an insulating housing having a plugging portion for plugging with a mating connector;

an array of contact elements supported by said insulating housing;

said contact elements each having a contact section arranged within said insulating housing in a substantially parallel, laterally spaced relationship, an intermediate section extending from said contact section being laterally flat and fixed in said insulating housing, and a connection section extending from said intermediate section;

two pairs of said contact elements, one on each opposite end of said array, intersecting each other in said intermediate sections and arranged such that a lateral distance between said contact elements of said each of said two pairs is increased in said intermediate sections compared with a lateral distance between said contact sections; and other pairs of said contact elements arranged such that a lateral distance between said contact elements of each of said other pairs is decreased in said intermediate sections compared with a lateral distance between said contact sections and increased in said connection sections.

2. A modular connector according to claim 1, wherein one of said pairs of said contact elements is made from a first reed frame, and the other from a second reed frame, with one of said first and second reed frames being substantially flat.

3. A modular connector according to claim 1, wherein said intermediate sections are molded with said insulating housing, with said connection sections bent in an L-shape from said insulating housing.

4. A module connector according to claim 3, wherein said lateral distance of said contact elements of said other pairs is increased after said L-shaped bends.

5. A module connector according to claim 3, wherein said connection sections of said contact elements permit mounting on a board up to said L-shaped bends so that a height of said module connector is minimized.

6. A modular connector according to claim 3, wherein said insulating housing has said plugging portions at two tiers, said contact elements being provided in each of said tiers, and the connection sections of said other pairs of said contact elements are spaced in each of said tiers so as to optimize crosstalk characteristics.

* * * * *